US005465800A

United States Patent [19]

Pearce et al.

[11] Patent Number: 5,465,800

[45] Date of Patent: Nov. 14, 1995

[54] ROLLING CUTTER DRILL BITS

[75] Inventors: David E. Pearce, Spring; Thomas A. Wick, Houston, both of Tex.

[73] Assignee: Camco International Inc., Houston, Tex.

[21] Appl. No.: 111,373

[22] Filed: Aug. 24, 1993

[30] Foreign Application Priority Data

Aug. 26, 1992 [GB] United Kingdom ..... 9218100

[51] Int. Cl.[6] ..... E21B 10/20

[52] U.S. Cl. ..... 175/368; 175/369; 175/371

[58] Field of Search ..... 175/371, 367, 175/368, 369, 370, 372

[56] References Cited

U.S. PATENT DOCUMENTS

| | | | |
|---|---|---|---|
| 4,911,255 | 3/1990 | Pearce | 175/368 |
| 4,991,671 | 2/1991 | Pearce et al. | 175/369 |
| 5,080,183 | 1/1992 | Schumacher et al. | 175/371 |

*Primary Examiner*—Terry Lee Melius

[57] ABSTRACT

A method of manufacturing a rolling cutter drill bit comprising a bit body which carries cutter assemblies each of which includes a cutter journal on the bit body, a cutter rotatably mounted on the journal, and a threaded retention ring screwed onto the cutter to retain the cutter on the journal while permitting a limited degree of axial displacement of the cutter relative to the journal. The method comprises the steps of predetermining a desired magnitude of maximum permitted axial displacement between the cutter and the journal, and then employing components for the cutter assembly which are so dimensioned as to provide, when assembled to form the cutter assembly, a maximum permitted axial displacement which is not greater than the predetermined magnitude. The appropriately dimensioned components may be specifically manufactured to the required size, or may be selected from a stock of components of differing sizes. Alternatively the maximum permitted axial displacement may be determined by adjusting the axial position of the retaining ring on the cutter during assembly.

26 Claims, 5 Drawing Sheets

ROLLING CUTTER DRILL BITS

BACKGROUND OF THE INVENTION

1. Field of the Invention

The invention relates to rolling cutter drill bits for drilling holes in subsurface formations, and particularly to the design and clearances of the internal bearing structures for such bits.

2. Description of Related Art

As is well known in the art, a rolling cutter drill bit typically comprises a bit body including a plurality of lugs, usually three, each of which includes a journal on which a rotating cutter is supported by suitable bearings. The cutters rotate relative to their respective journals, as the bit is rotated within an earth formation, to perform a cutting action on the formation. Each cutter is secured to its journal by means of a retention assembly, and typical forms of such assembly are shown in U.S. Pat. Nos. 4,838,365 and 5,080,183. A small amount of axial play between the cutter and journal is required to facilitate the appropriate rotating action of the cutter, and to prevent binding of the cutter as a result of differential thermal expansion. The retention assembly must therefore be designed to allow some minimum degree of relative axial displacement or play between the cutter and journal.

A rolling cutter bit normally includes a lubrication system to provide lubricant to the bearings between the cutter and the journal in the cutting assembly. These lubrication systems typically include a lubricant reservoir within the bit from which lubricant is supplied to the bearings, and means for pressure balancing the lubricant relative to the environment exterior to the bit. In order to maintain the lubricant within the bit, a seal assembly is provided to seal between the rolling cutter and the stationary journal. Various forms of seal assembly are described and shown in U.S. Pat. Nos. 3,137,508, 3,761,145, 2,590,759, 4,466,622, 4,516,641, 4,838,365 and 5,080,183.

The prior art has established that axial play of the rolling cutters in sealed and lubricated drilling bits causes significant lubricant volume transfers inside the cutter bearing, particularly near the seal. These volume changes lead to high pressure differentials across the seal which limit seal reliability and ultimately limit the useful life of the bit. In recognition of these problems, the prior art focused upon seal designs to tolerate these unwanted pressure fluctuations. For instance, in U.S. Pat. No. 3,137,508 it was recognised that pressure differentials of up to 50 psi can appear at the seal at the rate of 1800 fluctuations per minute. Thus, a seal was invented which leaked a small amount of lubricant outwardly in response to excess internal pressure. In U.S. Pat. No. 3,761,145 a rigid face seal design was disclosed which also was designed to leak lubricant to limit internal pressure inside the rolling cutter.

Another type of rigid face seal shown in U.S. Pat. No. 2,590,759 was designed to move axially to compensate for lubricant volume fluctuations rather than release lubricant. Somewhat similar volume compensating rigid face seal designs are shown for drill bits in U.S. Pat. Nos. 4,466,622 and 4,516,641. In particular, U.S. Pat. No. 4,516,641 discusses at length exactly how much axial displacement of the seal is required for a given amount of axial play in the rolling cutter. There are many other patents for drill bits which disclose seal designs which better tolerate the pressure fluctuations of the lubricant. One commonality throughout these inventions, however, is that the presence of these pressure fluctuations is detrimental to bit life.

As shown in the prior art, many factors combine to cause pressure fluctuations in face seal assemblies, however, the one factor that drives the rest is the permitted axial play between the rotating cutter and the journal which carries it. If axial play were to be zero for the life of the bit, there would be no volume changes to drive pressure fluctuations. However, as previously explained, the design of the bit must always provide some minimum degree of axial play.

A common problem of bits incorporating rigid face seals is inconsistency of performance. Our belief is that prior designs for rigid face seals in rock bits concentrated on the seal assembly design with less regard to the other factors. In particular, the critical design factor affecting seal life, i.e. the maximum permitted axial displacement of the cutter with respect to the journal on which it is mounted, has been allowed to vary considerably from one assembly to the next during manufacture.

SUMMARY OF THE INVENTION

An object of the present invention is to provide a new method for the manufacture of rolling cutter assemblies for drill bits whereby the maximum permitted axial displacement between each cutter and its journal may be established at a specific desired limit, greater than zero, to avoid the disadvantages resulting from excessive amounts of axial play, as well as variations in axial play from one assembly to the next.

According to one aspect of the invention there is provided a method of manufacturing a rolling cutter drill bit of the kind comprising a bit body, and at least one cutter assembly including a cutter journal on the bit body, a cutter rotatably mounted on the cutter journal, and a retention assembly to retain the cutter on the journal while permitting a limited degree of axial displacement of the cutter relative to the journal, the method comprising the steps of predetermining a desired magnitude of maximum permitted axial displacement between the cutter and the journal, and employing components for the cutter assembly which are so dimensioned as to provide, when assembled to form the cutter assembly, a maximum permitted axial displacement which is not greater than said predetermined magnitude.

In each case, the predetermined magnitude of the axial play will be greater than the minimum value ($D_{MIN}$) required to prevent binding of the cutter during drilling. The actual value of the axial play in the assembly drill bit is therefore preferably as far below the predetermined maximum as possible, while still remaining above the minimum value.

In a preferred embodiment of the invention there is provided a method of manufacturing a rolling cutter drill bit of the kind comprising a bit body, at least one cutter assembly comprising a cutter journal on the bit body, a cutter rotatably mounted on the cutter journal, a thrust bearing between adjacent surfaces on the journal and cutter, and a retention assembly mounted on one of said journal and cutter and having a first contact face opposed to a second contact face on the other of said journal and cutter, whereby relative axial displacement between said cutter and journal is limited in one direction by said thrust bearing and in the opposite direction by contact between said first and second contact faces, the method comprising the step of accurately pre-selecting the axial distance between said first and second contact faces when said thrust bearing is fully engaged, thereby limiting the maximum permitted axial displacement between the cutter and journal.

The invention includes within its scope various methods of accurately pre-selecting the axial distance between said first and second contact faces. According to one method, the axial distance between said contact faces may be accurately pre-selected by adjusting an appropriate axial dimension of said cutter, journal and/or retention assembly, prior to assembly of said components.

Alternatively, the axial distance may be accurately pre-selected by selecting, from a supply of retention assemblies including different axial dimensions, a retention assembly having an axial dimension to provide, upon assembly of the components, a desired axial distance between said first and second contact faces.

Alternatively or additionally, the axial distance may be accurately pre-selected by providing on at least one of the components a spacer located to adjust the axial distance between said first and second contact faces, said spacer being selected from a supply of spacers having different axial dimensions, to provide, upon assembly of the components, a desired axial distance between said first and second contact faces.

The spacer may be located between the retention assembly and the component on which it is mounted so as to adjust the position of the first contact face. Alternatively, the spacer may be mounted so as itself to provide the first or second contact face in a position determined by the axial dimension of the spacer. In a further alternative arrangement the spacer may comprise the aforesaid thrust bearing itself.

In a still further alternative arrangement the retention assembly may be mounted on one of said journal and cutter for axial adjustment relatively thereto, the axial distance between the first and second contact faces being accurately pre-selected by adjusting the axial position of the retention assembly on the component on which it is mounted, after assembly of the components.

The axial adjustment of the retention assembly may comprise the steps of first adjusting the retention assembly in one direction to a position where the first and second contact faces are in contact with one another, then adjusting the retention assembly in the opposite direction by a predetermined amount to provide a desired axial distance between said contact faces, and then securing the retention assembly to the component on which it is mounted.

In any of the above arrangements the retention assembly may comprise a circumferential element coaxial with the cutter and journal, the element being in screw-threaded engagement with one of said cutter and journal, preferably the cutter.

The axial distance between said first and second contact faces, and hence the maximum permitted axial displacement between the cutter and journal, is preferably in the range of about 0.002 inches to 0.010 inches, and more preferably in the range of about 0.003 inches to 0.006 inches.

In an alternative embodiment of the invention, the retention assembly may comprise an array of separate bearing elements located within opposed peripheral grooves in the cutter and cutter journal respectively, the bearing elements being selected from a supply of bearing elements of different dimensions to provide, upon assembly with the cutter and journal, a maximum permitted axial displacement of said predetermined magnitude. Alternatively or additionally, the grooves in the cutter and journal may be dimensioned to provide a maximum permitted axial displacement of said predetermined magnitude. The bearing elements may comprise ball bearings.

The invention includes within its scope a rolling cutter drill bit when manufactured using any of the methods referred to above.

DETAILED DESCRIPTION OF THE PREFERRED EMBODIMENTS

Figure 1:
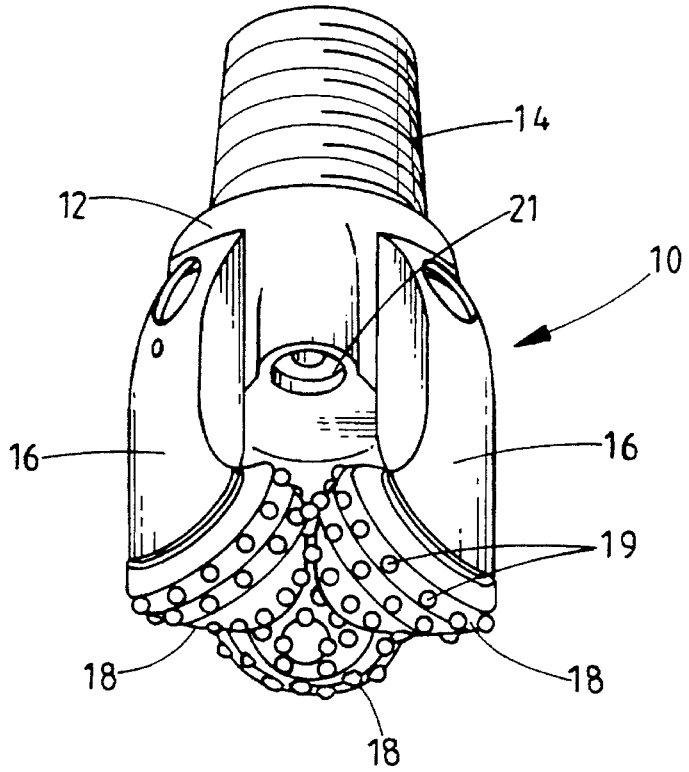
FIG. 1 is a perspective view of one form of rolling cutter drill bit in accordance with the present invention.

FIG. 1 shows a rotating cutter drill bit 10 including a bit body provided at its upper end with a threaded coupling 14 for connection to a drill string. The bit body 12 includes three elongate lugs 16 each of which has a cutter 18 rotatably mounted thereon. In well known manner, each cutter 18 has cutting teeth 19 mounted thereon for engaging in cutting relation the formation being drilled. Drilling fluid for cooling and cleaning the cutters is supplied to suitable nozzles 21 in the bit body which communicate with a central passage (not shown) in the bit body.

Figure 2:
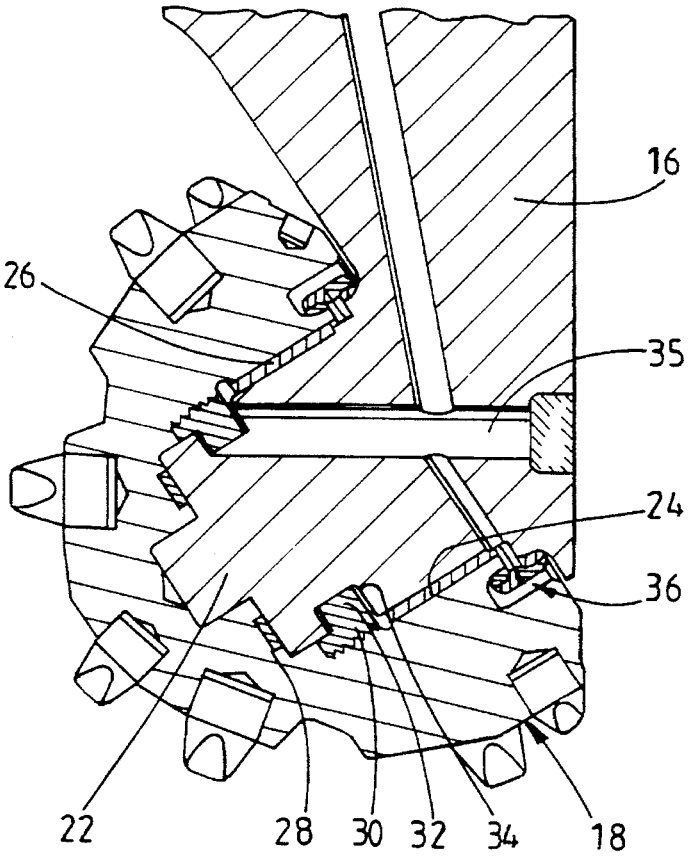
FIG. 2 is a part-sectional view of a lug and cutter assembly of the drill bit of FIG. 1.

FIG. 2 shows one of the three lug and cutter assemblies of the drill bit in vertical section. Each lug 16 includes a fixed cutter journal 22 which is received within a circular stepped socket 24 in the cutter 18. A cylindrical bearing sleeve 26 encircles the journal 22 and an annular thrust bearing 28, mounted in a recess in a shoulder within the socket 24, engages an annular bearing surface on the journal 22.

The cutter 18 is located axially on the journal 22 by a threaded retention ring 30 which threadably engages the cutter 18 and is formed with an inwardly extending annular flange 32 which engages within a peripheral groove 34 in the journal 22.

To enable assembly, the retention ring 30 is formed in two semi-circular pieces which cooperate to form the complete ring.

The cutter 18 is assembled on the journal 22 by first engaging the flanges 32 on the two parts of the retention ring 30 within the peripheral groove 34 in the journal 22. The cutter 18 is then fitted over the journal and rotated to threadedly engage the retaining ring 30. During screwing on of the cutter 18, the retaining ring 30 is held against rotation on the journal 22 by inserting through a suitable access hole 35 in the lug and journal an elongate assembly tool the end of which enters a notch formed in the retaining ring 30.

Each lug/cutter assembly also includes a seal assembly between the root end of the journal 22 and a surrounding skirt portion of the cutter 18, such seal assembly being indicated at 36 in FIG. 2.

The seal assembly 36 shown in FIG. 2 is a non-compensating seal assembly of the kind described and illustrated in U.S. Pat. No. 5,040,624, and certain aspects of the invention are particularly applicable to bits having non-compensating seal assemblies. However, this particular form of seal assembly is shown by way of example only and the invention is not limited to any particular form of seal assembly. Thus, the seal assembly might be another form of non-compensating seal assembly, or might be a compensating seal assembly, for example of the kinds described and illustrated in U.S. Pat. Nos. 4,466,622 and 4,516,641.

As previously discussed, during operation of the drill bit, axial play will occur in the form of relative movement between the cutter 18 and the journal 22 generally along the longitudinal axis of the journal. The present invention is directed, in one of its aspects, to methods and apparatus for controlling and limiting this movement.

Figure 3:
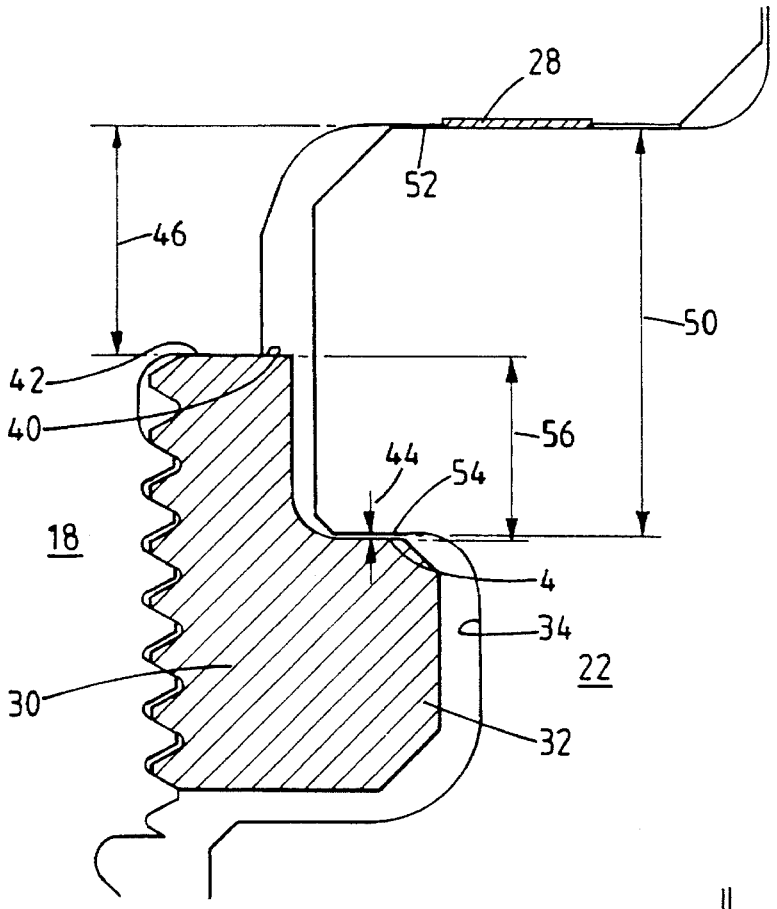
FIG. 3 is an enlarged sectional view of part of the journal, cutter and retaining assembly of the embodiment of FIG. 2, FIGS. 4 to 8 are similar views to FIG. 3 of alternative embodiments.

FIG. 3 shows, on an enlarged scale, a section through part of the retaining ring 30 and adjacent parts of the cutter 18 and journal 22.

As is apparent from FIG. 3, after assembly of the cutter 18 on the journal 22 an outer shoulder 40 of the retaining ring 30 seats against an outer seating face 42 on the cutter 18. The maximum axial play between the cutter 18 and journal 22 is then determined by the size of the gap 44 between a surface 48 on the annular flange 32 and the adjacent surface 54 of the groove 34 in the journal 22, when the thrust bearing 28 is in engagement with the end surface 52 on the journal.

The size of the gap 44 is determined by the relative dimensions of the three components, i.e. by (a) the axial dimension 46 between the bearing surface of the thrust bearing 28 on the cutter 18 and the seating face 42, (b) the axial dimension 56 between the faces 40 and 48 of the retention ring 30, and (c) the axial dimension 50 between the faces 52 and 54 on the journal 22. Thus gap 44=dimension 46+dimension 56 –dimension 50.

It will be apparent that even relatively restricted tolerances in the manufacture of the cutter 18, thrust bearing 28, journal 22 and retention ring 30 can potentially lead to dramatically different magnitudes of axial play at 44. For example, conventional manufacturing tolerances used in the industry for such components are typically ±0.002–0.003 inches. In practice, this typically results in axial play anywhere in the range of 0.002–017 inches.

Furthermore, during normal drilling the direction of rotation of the cutter 18 on the journal 22 is such as to tend to tighten the engagement of the retention ring 30 against the surface 42 on the cutter 18. However, some drilling operations can generate forces which cause reverse cutter rotation and in some cases this may cause the cutter 18 to unscrew from the retention ring 30, thus bringing the surface 40 on the retaining ring away from the surface 42 on the cutter. This will increase the gap 44 and hence the axial play between the cutter and journal. Attempts to prevent unscrewing of the retention ring from the cutter 18 by use of conventional thread locking fluid have not been particularly successful.

Due to the above factors, there has hitherto been substantial variation in the axial play, i.e. the maximum permitted axial displacement, of the cutter on the journal when one drill bit is compared with another. As previously explained, however, the satisfactory operation of the face seal between the cutter and journal greatly depends on the magnitude of this maximum permitted axial displacement and according to the present invention therefore such axial displacement is accurately controlled so as to enhance the performance of the face seal.

According to one method of putting the invention into effect, the dimensions 46, 50 and 56 are accurately determined during manufacture so as to result in a gap 44 which is not greater than a preselected maximum desired magnitude. This may be achieved by accurate measurement of the dimensions 46, 50 and 56 before assembly and then adjustment of one or more of the dimensions by machining or grinding one specific dimension so that the gap 44 is at or below the required value. The maximum desirable value for the gap 44 may be calculated by methods to be described. It will be appreciated that, although the width of the gap 44 may be less than the calculated maximum value, it must always be greater than the minimum width necessary to prevent the cutter binding on the journal during drilling, as a result of differential thermal expansion. This applies to all embodiments of the invention.

Alternatively, a stock of retaining rings 30 may be available, the dimension 56 of which rings varies according to normal manufacturing tolerances. The dimensions 50 and 46 of the journal and associated cutter may then be accurately measured and a retaining ring selected from the stock of retaining rings which has an axial dimension 56 which is appropriate to give a gap 44 at or below the preselected maximum value when the components are assembled.

Figure 4:
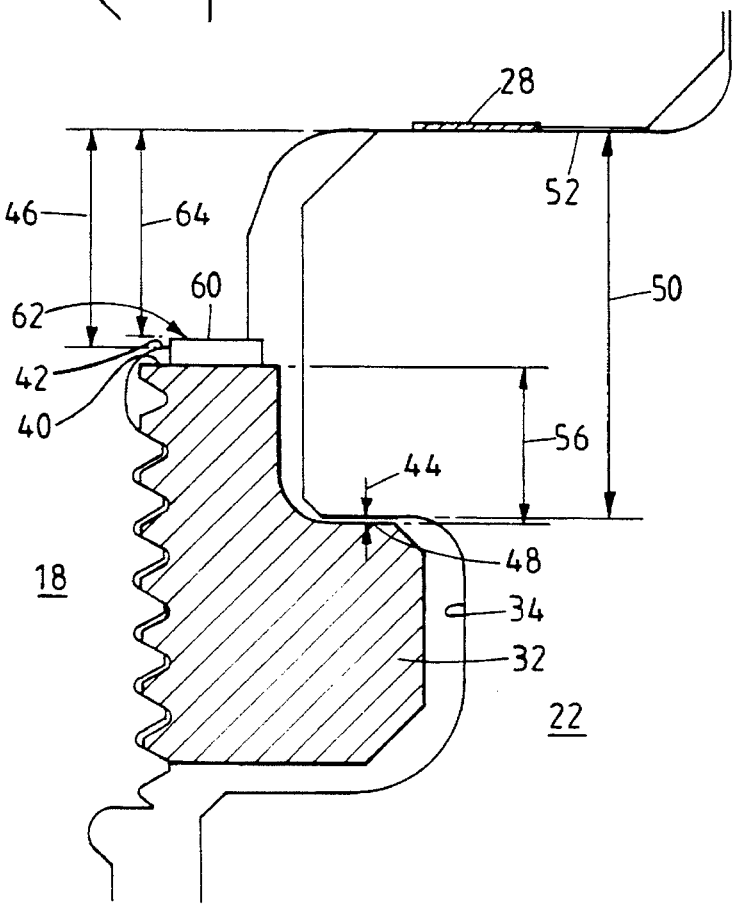

FIG. 4 shows an alternative method for predetermining the maximum permitted axial displacement between the cutter and journal. Components essentially identical to those of FIG. 3 have been numbered identically.

In the embodiment of FIG. 4, an annular recess 60 is formed in the seating face 42 of the cutter 18. The recess 60 partly retains an annular spacer or shim 62 and the shim 62 is utilised to compensate for variations in the above mentioned dimensions which effect the magnitude of the gap 44.

For a particular combination of cutter 18, journal 22 and retaining ring 30 the dimensions 46, 50 and 56 will be determined, subject to normal manufacturing tolerances. The depth of the recess 60, i.e. the dimension 46 minus the dimension 64 between the bearing surface of the thrust bearing 28 and the bottom surface of the recess 60, will also be determined. These dimensions are accurately measured and a calculation made of the thickness of shim 62 which will be required to provide a gap 44 of the maximum desired magnitude. A shim having a thickness equal to or less than the calculated value will then be manufactured or selected from a supply of shims of different thicknesses. The selected shim is then located in the recess 60 and the components assembled together in the manner previously described.

It is currently believed that the bit should have a predetermined axial play 44 preferably falling in the range of 0.002–0.010 inches, with the axial play needing to be limited to 0.003–0.006 inches in many environments, so as to ensure optimal operation of sealing assemblies as previously described.

Figure 5:
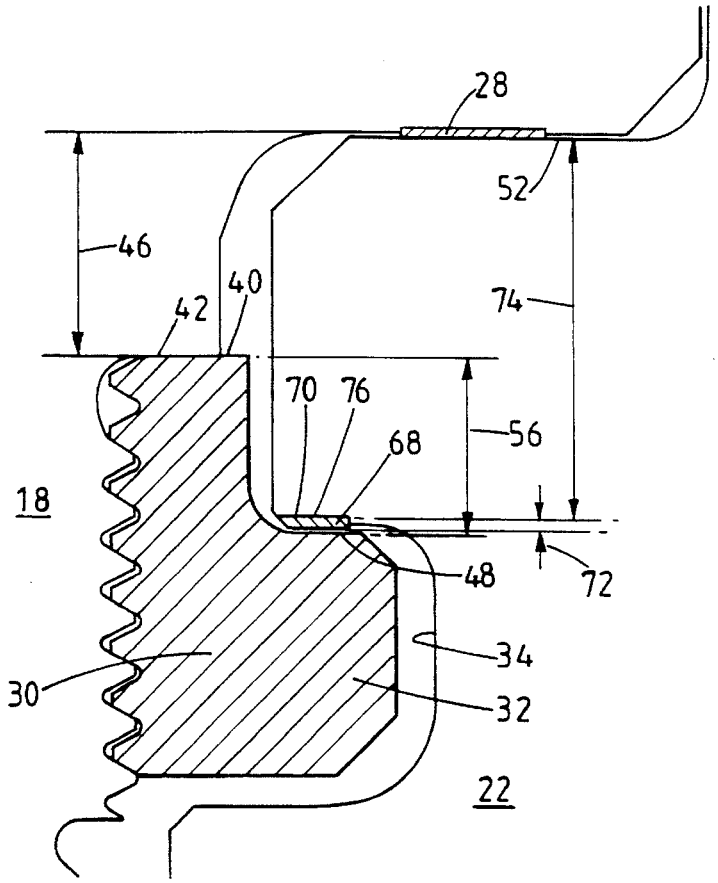

Referring now to FIG. 5, there is shown another alternative embodiment for the construction of a lug/cutter assembly. Once again, elements similar to those previously described in relation to FIG. 3 have been numbered similarly. In the embodiment of FIG. 5, instead of the use of a shim (element 62 in FIG. 4) the axial play between the retaining ring 30 and journal 22 is determined by the axial thickness of a floating washer thrust bearing 68. The floating washer thrust bearing 68 is housed within an annular recess 70 formed in the surface of the journal 22 adjacent the recess 34. The axial dimension 72 of the floating washer thrust bearing is selected to adjust the gap 44 to the desired value. As before, the axial thickness of the thrust bearing 68 may be determined either by forming a washer of the appropriate thickness or by selecting a washer of appropriate thickness from a supply of washers of different thicknesses.

Once the dimensions 46 and 56, and the dimension 74 between the inner bearing surface 52 and the surface 76 of the recess 70, are determined, the required maximum thickness of the floating washer thrust bearing 68 is equal to dimension 46+dimension 56– dimension 74–desired gap 44.

Figure 6:
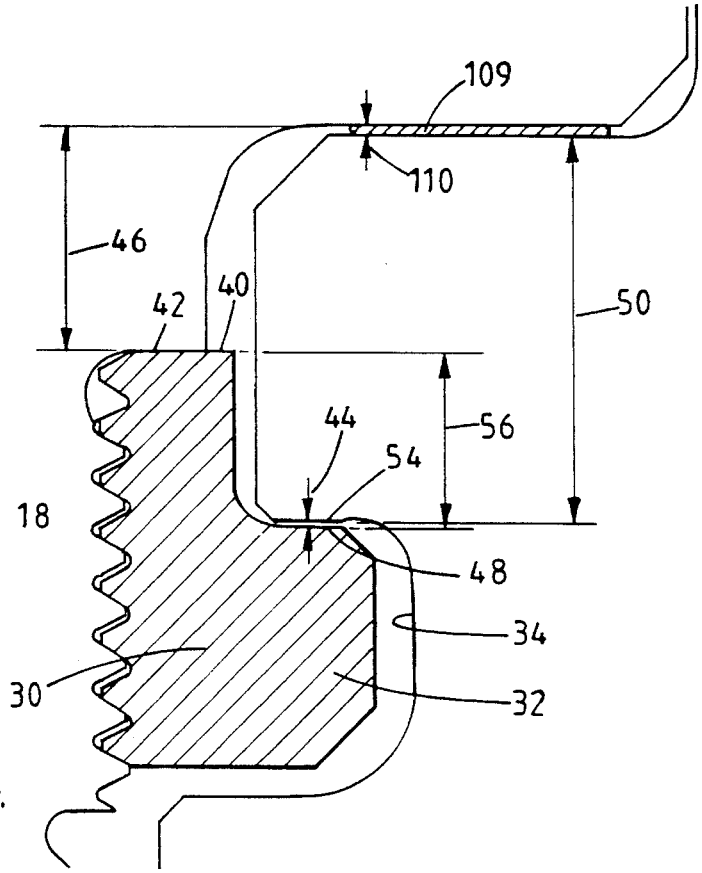

FIG. 6 is a modified, and preferred, version of the arrangement shown in FIG. 5 in which the size of the gap 44 is adjusted by adjusting the axial thickness 110 of the annular thrust washer 109 which is mounted between opposed annular surfaces on the cutter 18 and journal 22 respectively.

It will be seen that gap 44=dimension 46+ dimension 56–dimension 50–the thickness 110. Thus, the thickness 110 is selected so as to provide a gap 44 which is equal to or less than the maximum desired axial play between the cutter 18 and journal 22. The thickness of washer 109 is adjusted by a suitable lapping operation or, alternatively, a washer of appropriate thickness may be selected from a stock of washers of different thicknesses.

Figure 7:
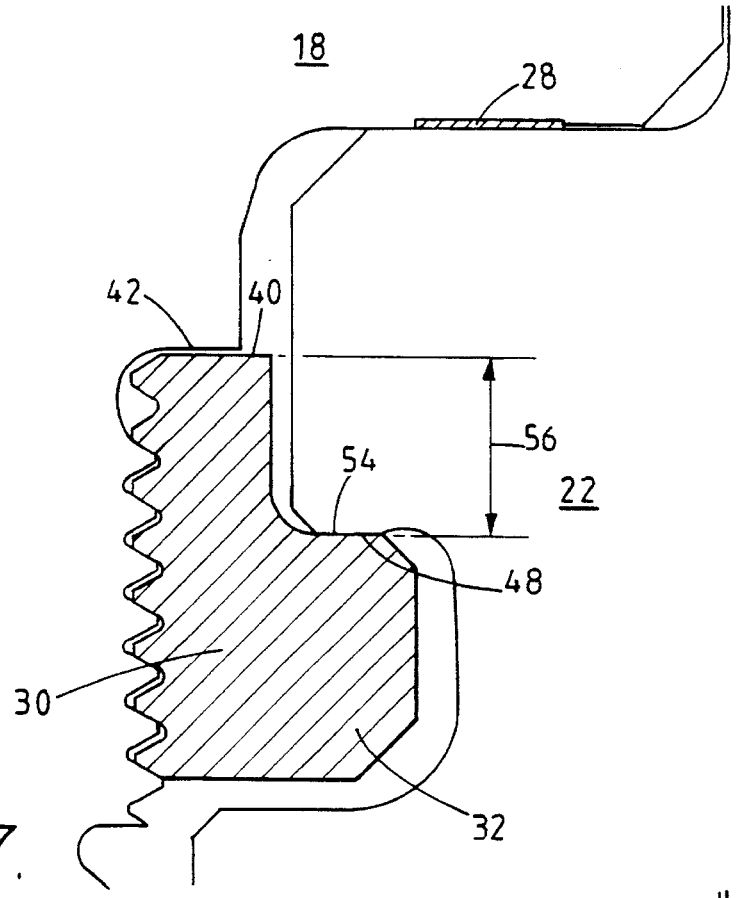
Figure 8:
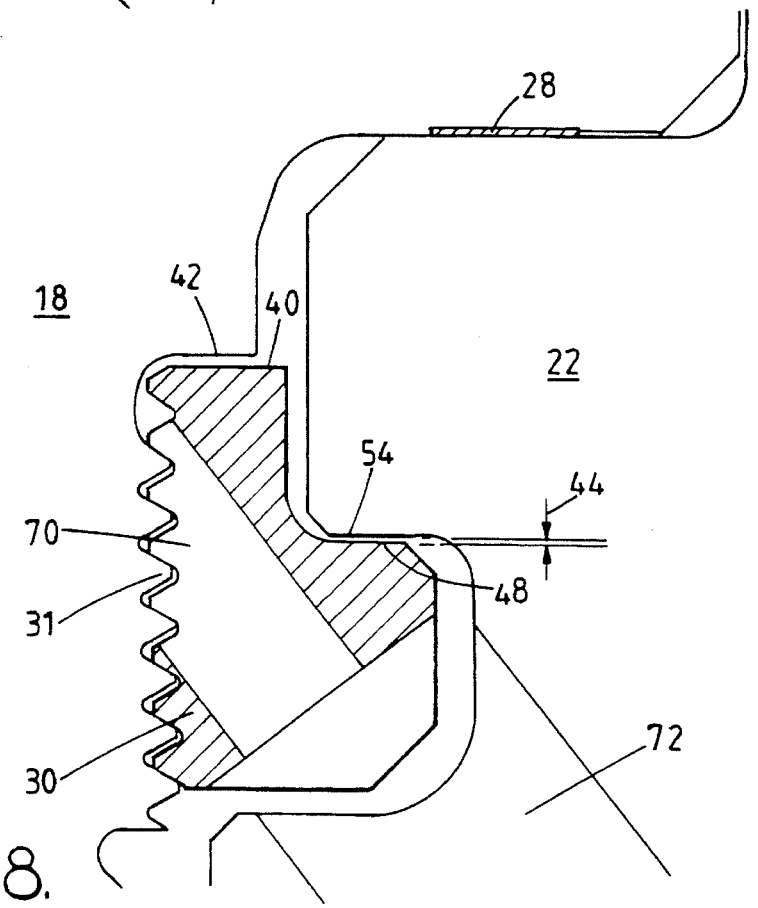

A further alternative method of determining the axial play is shown in FIGS. 7 and 8.

According to this method the axial dimension 56 of the retaining ring 30 is such that as the cutter 18 is screwed onto the retaining ring 30, the surface 48 on the retaining ring comes into contact with the adjacent surface 54 on the journal 22 before the end surface 40 on the retaining ring comes into engagement with the surface 42 on the cutter, i.e. the end portion of the journal 22 becomes clamped between the retaining ring and the thrust bearing 28. This position is shown in FIG. 7, the gap between the surfaces 40 and 42 being indicated at 45.

In order then to set the predetermined gap 44 between the surface 48 on the retaining ring and the surface 54 on the journal, the cutter 18 is unscrewed through a predetermined rotation while the retaining ring 30 is held against rotation. This enlarges the gap 45 between the surfaces 40 and 42 as the retaining ring is backed off, and creates the gap 44, as shown in FIG. 8. The extent of axial movement of the retaining ring 30 to form the desired gap 44 will depend on the extent of rotation of the cutter, and the pitch of the thread between the retaining ring 30 and the cutter 18. The relationship may be readily calculated so as to determine the rotation of the cutter 18 which is necessary to establish a desired gap 44.

Once the desired gap 44 has been established by rotating the cutter 18 relatively to the retaining ring 30, the retaining ring 30 is locked to the cutter 18. This may be achieved in a number of ways. For example, the inter-engaging threads of the retaining ring 30 and cutter 18 may be locked together by a suitable thread-locking liquid although, as previously mentioned, such method has not hitherto proved to be particularly successful. A preferred method is therefore to deform the threads on the cutter, and such method is described and claimed in our co-pending U.S. Application No. 08/110,854, filed on the same date as the present application.

In all of the arrangements according to the invention, it is necessary to hold the retaining ring 30 against rotation while the cutter 18 is screwed onto it. As previously mentioned, one suitable means for achieving this is to provide the retaining ring with a notch or hole which is registered with a passage in the journal 22 when the retaining ring is assembled on the journal. The retaining ring may then be held against rotation by an elongate retaining tool which is temporarily passed along the passage and is engaged with the notch or hole in the retaining ring. Such an arrangement is described in U.S. Pat. No. 5,012,701. In the arrangement of FIGS. 7 and 8 the retaining ring 30 is formed with a hole 70 (see FIG. 8) which, during assembly, is located in register with an angled passage 72 which extends through the journal so that the end of the passage remote from the ring 30 opens to the exterior of the bit. While the cutter 18 is being screwed onto the retaining ring 30, the ring is held against rotation by introducing an elongate retaining tool along the passage 72 and engaging the end of the tool with the hole 70 in the ring. If the ring is subsequently locked to the cutter 18 by deforming the exposed threads on the cutter, as described in the above-mentioned co-pending application, one and the same passage 72 and hole 70 in the retaining ring may serve both for engagement by the retaining tool to hold the ring 30 against rotation during assembly and for subsequent access by the tool for deforming the threads 31.

Those skilled in the art will recognise from this disclosure that methods and apparatus for limiting axial displacement as disclosed herein may also be utilised in controlling axial displacement where retention means other than the described threaded retention ring are utilised. For example, other retention means include ball bearings, compression or retention rings (conventionally known as snap rings) or other rings or pieces inserted in assembly grooves in the cutter or cutter journal.

In such other retention means variations in size and relationship of contact surfaces may be used to adjust and control axial play in accordance with the techniques described and illustrated herein. For example, with retention assemblies such as ball bearings, measurement and control of additional dimensions will be required, when compared with arrangements of the kind described in relation to FIGS. 3 to 8.

In arrangements utilising ball bearing retention means, such as shown in U.S. Pat. No. 4,838,365, the axial play can be adjusted by selecting steel balls of an appropriate diameter. In the case where a snap ring retention assembly is used, such as shown in U.S. Pat. No. 4,516,641, FIG. 7, the axial play can be adjusted by varying the sectional diameter of the snap rings.

Figure 9:
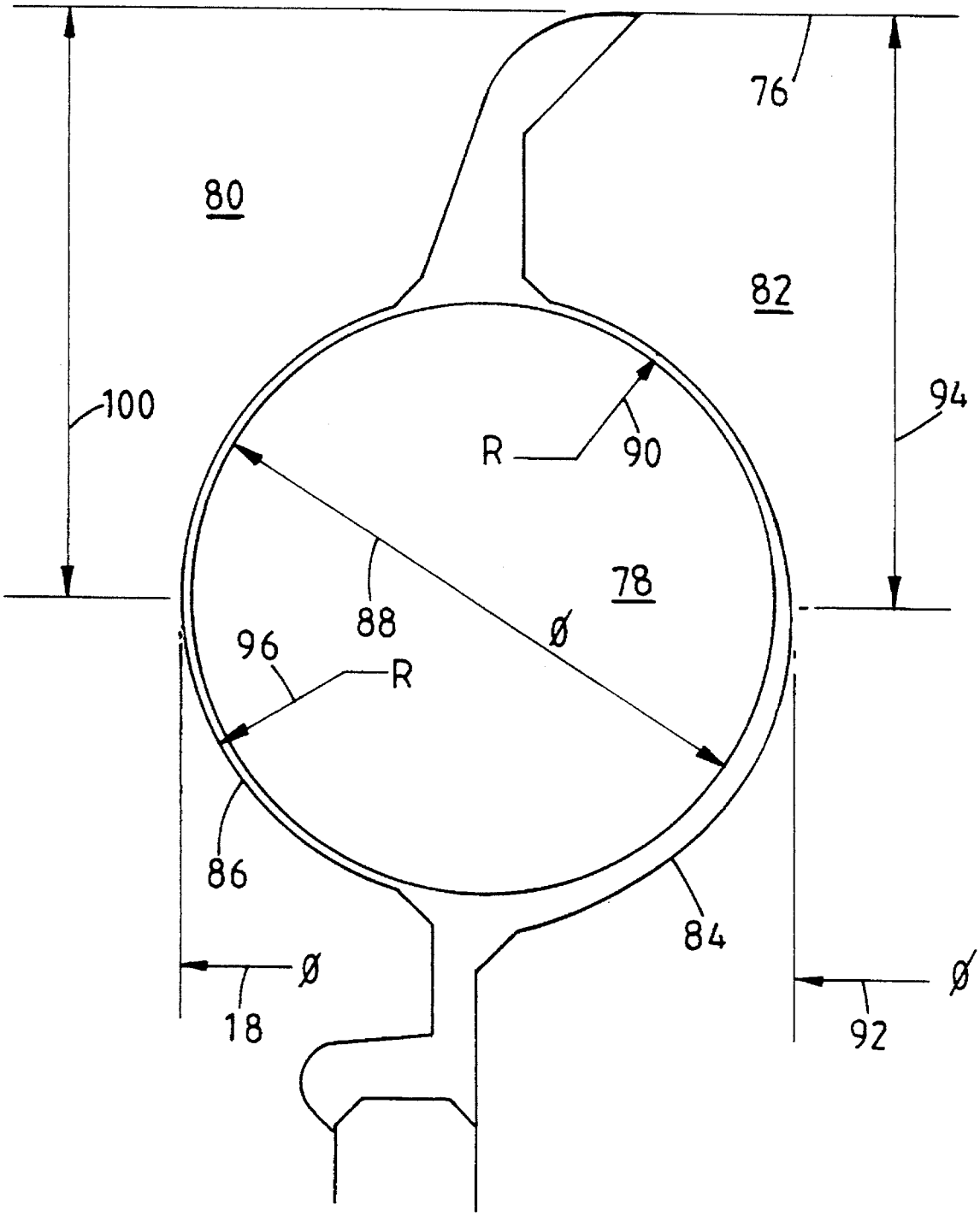
FIG. 9 is an enlarged sectional view of part of a journal, cutter and retaining assembly in a further embodiment of the invention.

FIG. 9 shows, on an enlarged scale, part of an arrangement where ball bearings are used as retention/bearing elements between a cutter 80 and the journal 82 on which the cutter is rotatably mounted.

An array of similar ball bearings 78 are disposed side-by-side around the periphery of the journal 82 and are located in registering peripheral grooves 84, 86, of part-circular cross-section, in the journal and cutter respectively. Up to seven dimensions of the arrangement may affect the axial play between the cutter and journal, such dimensions being indicated in FIG. 9 as follows:

88—the diameter of the ball bearing

90—the cross-sectional radius of the peripheral groove 84 in the journal 82

92—the overall diameter of the groove 84

94—the distance of the central plane of the groove 84 from the thrust bearing surface 76 on the journal 82

96—the cross-sectional radius of the peripheral groove 86 in the cutter 80

98—the overall diameter of the groove 86

100—the distance of the central plane of the groove 86 from the surface 76

The axial play, or maximum permitted axial displacement, between the cutter and journal can be calculated from these dimensions. Accordingly, in accordance with the invention, a desired magnitude of axial play may be provided by appropriate pre-selection of these dimensions. This may be achieved by allowing certain of the dimensions to vary from a nominal value by normal manufacturing tolerances. These dimensions are then accurately measured and the axial play adjusted by accurate adjustment or selection of other dimensions. For example, given the other dimensions of the assembly, the axial play may be brought to the required value by utilising ball bearings of the exact diameter required to achieve this, such bearings being accurately measured bearings selected from a supply of ball bearings, the dimensions of which vary according to the normal manufacturing tolerances.

The invention lies, in its broadest aspect, in predetermining the axial play in a cutter/lug assembly of a rolling cutter drill bit, in contrast to prior art arrangements in which the axial play was not predetermined but was allowed to vary, without control, according to tolerances in the manufacture and assembly of the components.

In previous design of rolling cutter drill bits, little attempt has been made to consider the effect on the sealing system of the various important parameters in the design of the rest of the drill bit, and the inter-dependence between such parameters, such as the axial play, the lubricant reservoir capacity, the lubricant passaging design, the lubricant flow properties, the amount of volume compensation and movement of the sealing assembly. According to another aspect of the present invention, the inter-dependence of the above parameters is established in a manner best suited to the optimal design of the sealing assemblies. That is to say, methods will now be described for determining the maximum desired axial play, or permitted axial displacement, which is desirable for a given design of drill bit, and which magnitude of axial play may then be incorporated in the drill bit, during manufacture, by any of the methods previously described.

The differential pressure present adjacent to the seal assembly in a rolling cutter drill bit could be determined by the following formulae taken from "The Standard Handbook for Mechanical Engineers", Baumeister & Marks, seventh edition, pages 3-58 and 3-59:

$$h=f*(L/d)*(V^2/2g)$$

$$Re=Vd/\nu$$

If Re is less than 1200 flow is laminar, therefore:

$$f=64/Re$$

Where:

h=head loss f=friction factor

L=length of tube d=diameter of tube

V=flow velocity in tube g=acceleration due to gravity

Re=Reynold's number

ν=kinematic viscosity of the fluid.

Finally to determine P the pressure loss in PSI:

$$P=h*SG*2g$$

where SG is the specific gravity of the lubricant.

Unfortunately, the dimensional characteristics of the lubricant passageways adjacent to the seal area cannot be easily characterised unless the bit is designed with a direct fluid passageway to the seal area as shown in U.S. Pat. No. 5,080,183. The inability to characterise the fluid passageways through the close fitting bearing assembly adjacent to the seal area led Burr in the above-mentioned U.S. Pat. No. 4,516,641 to the assumption that no lubricant flow occurs to or from the seal system through the bearing clearances. This simplifying assumption proved useful for his volume compensation design parameters but cannot be applied to sealing systems that behave as non-compensating designs. There is a means, however, to determine the maximum amount of axial play allowable in a bit assembly to ensure long life of these non-compensating seal assemblies.

The first formula relates to non-compensating seal designs intended to leak during operation. This formula relates the lubricant reservoir volume, the swept area of the cutter assembly and the number of cycles of bit life to axial displacement. The intent is to determine the maximum axial displacement allowable to reach a predetermined number of cycles prior to depletion of the lubricant reservoir. Failure of the cutter assembly occurs very quickly after lubricant depletion. The formula is as follows:

$$D=D_{min}+(V/c*A*N)$$

Where:

D=assembled maximum axial displacement $D_{min}$=thermal expansion clearance

V=lubricant reservoir volume c=experimentally determined constant

A=swept area of seal

N=number of cycles design life

For a typical rock bit 12¼ inches diameter or less:

D=0.002" to 0.015"

$D_{min}$=0.001" to 0.003"

V=1 $in^3$ to 2.2 $in^3$ c=$1.5\times10^{-4}$ to $2.2\times10^{-4}$

A=1 $in^2$ to 4 $in^2$

N=0.5 to $2.5\times10^6$ cycles

The actual values will vary according to the specific bit design. This formula yields the maximum value allowable for axial play upon assembly of the bit. Each cutter assembly is adjusted to less than or equal to this axial displacement, using any of the methods previously described in accordance with the invention.

For non-compensating seals designed for no leakage, the following formula for maximum axial displacement is used. The formula simplifies the flow equation and relates axial displacement to the pressures accounting for the loading history of the seal faces. The formula assumes primary seal failure is caused by load history and not lubricant depletion.

$$D=D_{min}+(t/\nu*c*A*N)$$

Where:

D=assembled maximum axial displacement $D_{min}$=thermal expansion clearance t=time period over which pulse is applied ν=lubricant kinematic viscosity c=experimentally determined constant A=swept area of cutter N=number of cycles design life For a typical rock bit 12¼ inches diameter or less:

D=0.003" to 0.008"

$D_{min}$=0.001" to 0.003"

t=0.005 to 0.05 sec.

ν= 0.1 to 28 $in^2$/sec $c=1$ to $3\times10^{-8}$ $A=3$ in$^2$ to 10 in$^2$ $N=0.5$ to $2.5\times10^6$ cycles Again, the actual values will vary according to the specific bit design. The formula yields the maximum value allowable for axial play upon assembly of the bit. Each cutter assembly is adjusted to less than or equal to this axial displacement. It is believed that this formula also controls seal life for compensated seal designs in applications where the pulse time is less than 0.033 seconds.

A third formula could be written in a similar manner, equating the maximum allowable axial play at assembly to bit life for any compensated sealing assembly using elastomeric energisers. The factors included would be those relating to "lift-off" of the energiser due to high unloading velocities of whichever energiser is being de-compressed. Some of these factors are: pulse time period, bit life desired, elastomer spring rate, elastomer damping coefficient, average state of elastomer compression, compensation ratio of cutter/seal assembly movement, and seal cavity geometry.

From the above formulae another aspect of controlling axial play is apparent. Not only should the maximum axial play of an assembly not be exceeded but, as previously explained, also a minimum axial play must be maintained. The minimum axial play for 12¼ tooth type bits, for instance, is about 0.003". Differences in thermal expansions within the bit assembly cause a reduction in axial displacement during operation. If the minimum axial displacement is not properly set, the cutter assembly will bind during operation and the bit will quickly fail. Therefore, the axial play set at assembly must fall within the prescribed range for full useful bit life.

We claim:

1. A method of manufacturing a rolling cutter drill bit of the kind comprising a bit body, and at least one cutter assembly including a cutter journal on the bit body, a cutter rotatably mounted on the cutter journal, and a retention assembly to retain the cutter on the journal while permitting a limited degree of axial displacement of the cutter relative to the journal, the method comprising the steps of specifying a desired magnitude &maximum permitted axial displacement between the cutter and the journal, and employing components for the cutter assembly which are so dimensioned as to provide, when assembled to form the cutter assembly, a maximum permitted axial displacement determined by measurement, which is not greater than said specified magnitude.

2. A method of manufacturing a rolling cutter drill bit of the kind comprising a bit body, and at least one cutter assembly including a cutter journal on the bit body, a cutter rotatably mounted on the cutter journal, and a retention assembly to retain the cutter on the journal while permitting a limited degree of axial displacement of the cutter relatively to the journal, the retention assembly comprising an array of separate beating elements located within opposed peripheral grooves in the cutter and cutter journal respectively, the method including the step of selecting the bearing elements by measuring the bearing elements in a supply of bearing elements of different dimensions and selecting, from said supply, beating elements having such dimensions as to provide, upon assembly with the cutter and journal, a maximum permitted axial displacement of a desired magnitude,

3. A method according to claim 2, wherein the grooves in the cutter and journal are dimensioned to provide a maximum permitted axial displacement of said desired magnitude.

4. A method according to claim 2, wherein the bearing elements comprise ball bearings.

5. A method of manufacturing a rolling cutter drill bit of the kind comprising a bit body, at least one cutter assembly comprising as components thereof, a cutter journal on the bit body, a cutter rotatably mounted on the cutter journal, a thrust bearing between adjacent surfaces on the journal and cutter, and a retention assembly mounted on one of said journal and cutter and having a first contact face opposed to a second contact face on the other of said journal and cutter, whereby relative axial displacement between said cutter and journal is limited in one direction by said thrust bearing and in the opposite direction by contact between said first and second contact faces, the method including the step of taking measurements to determine the axial distance between said first and second contact faces when said thrust bearing is fully engaged, and adjusting an appropriate axial dimension of at least one of said cutter, journal and retention assembly, prior to assembly of said components, thereby to adjust said axial distance between said first and second contact faces to a desired value.

6. A method according to claim 5, wherein the axial distance between said first and second contact faces, and hence the maximum permitted axial displacement between the cutter and journal, is in the range of about 0.002 inches to 0.010 inches.

7. A method according to claim 5, wherein the axial distance between said first and second contact faces, and hence the maximum permitted axial displacement between the cutter and journal, is in the range of about 0.003 inches to 0.006 inches.

8. A method of manufacturing a rolling cutter drill bit of the kind comprising a bit body, at least one cutter assembly comprising, as components thereof, a cutter journal on the bit body, a cutter rotatably mounted on the cutter journal, a thrust bearing between adjacent surfaces on the journal and cutter, and a retention assembly mounted on one of said journal and cutter and having a first contact face opposed to a second contact face on the other of said journal and cutter, whereby relative axial displacement between said cutter and journal is limited in one direction by said thrust bearing and in the opposite direction by contact between said first and second contact faces, the method including the step of taking measurements to determine the axial distance between said first and second contact faces when said thrust bearing is fully engaged, said retention assembly being provided by measuring the axial dimensions of retention assemblies in a supply of retention assemblies and selecting from said supply a retention assembly having an axial dimension to provide, upon assembly of the components, a desired axial distance between said first and second contact faces.

9. A method according to claim 8, wherein the axial distance between said first and second contact faces, and hence the maximum permitted axial displacement between the cutter and journal, is in the range of about 0.002 inches to 0.010 inches.

10. A method according to claim 8, wherein the axial distance between said first and second contact faces, and hence the maximum permitted axial displacement between the cutter and journal, is in the range of about 0.003 inches to 0.006 inches.

11. A method of manufacturing a rolling cutter drill bit of the kind comprising a bit body, at least one cutter assembly comprising, as components thereof, a cutter journal on the bit body, a cutter rotatably mounted on the cutter journal, a thrust beating between adjacent surfaces on the journal and cutter, and a retention assembly mounted on one of said journal and cutter and having a first contact face opposed to a second contact face on the other of said journal and cutter, whereby relative axial displacement between said cutter and journal is limited in one direction by said thrust bearing and in the opposite direction by contact between said first and second contact faces, the method including the step of taking measurements to determine the axial distance between said first and second contact faces when said thrust bearing is fully engaged, providing on at least one of the components a spacer located to adjust the axial distance between said first and second contact faces, said spacer being provided by measuring the axial dimensions of spacers in a supply of spacers having different axial dimensions and selecting from said supply a spacer having an axial dimension to provide, upon assembly of the components, a desired axial distance between said first and second contact faces.

12. A method according to claim 11, wherein the spacer is located between the retention assembly and the component on which it is mounted so as to adjust the position of the first contact face,

13. A method according to claim 11, wherein the spacer is mounted so as itself to provide the first or second contact face in a position determined by the axial dimension of the spacer.

14. A method according to claim 11, wherein the spacer comprises the aforesaid thrust bearing itself.

15. A method according to claim 11 wherein the axial distance between said first and second contact faces, and hence the maximum permitted axial displacement between the cutter and journal, is in the range of about 0.002 inches to 0.010 inches.

16. A method according to claim 11, wherein the axial distance between said first and second contact faces, and hence the maximum permitted axial displacement between the cutter and journal, is in the range of about 0.003 inches to 0.006 inches.

17. A method of manufacturing a rolling cutter drill bit of the kind comprising a bit body, at least one cutter assembly comprising as components thereof, a cutter journal on the bit body, a cutter rotatably mounted on the cutter journal, a thrust beating between adjacent surfaces on the journal and cutter, and a retention assembly mounted on one of said journal and cutter and having a first contact face opposed to a second contact face on the other of said journal and cutter, whereby relative axial displacement between said cutter and journal is limited in one direction by said thrust beating and in the opposite direction by contact between said first and second contact faces, the method including the step of taking measurements to determine the axial distance between said first and second contact faces when said thrust bearing is fully engaged, and adjusting the axial position of the retention assembly on the component on which it is mounted, after assembly of the components, to provide a desired axial distance between said first and second contact faces.

18. A method according to claim 17, wherein the axial adjustment of the retention assembly comprises the steps of first adjusting the retention assembly in one direction to a position where the first and second contact faces are in contact with one another, then adjusting the retention assembly in the opposite direction by an amount to provide a desired axial distance between said contact faces, and then securing the retention assembly to the component on which it is mounted.

19. A method according to claim 18, wherein the retention assembly comprises a circumferential element coaxial with the cutter and journal, the element being in screw-threaded engagement with one of said cutter and journal.

20. A method according to claim 17, wherein the axial distance between said first and second contact faces, and hence the maximum permitted axial displacement between the cutter and journal, is in the range of about 0.002 inches to 0.010 inches.

21. A method according to claim 17, wherein the axial distance between said first and second contact faces, and hence the maximum permitted axial displacement between the cutter and journal, is in the range of about 0.003 inches to 0.006 inches.

22. A rolling cutter drill bit comprising a bit body, a plurality of cutter assemblies each comprising a cutter journal on the bit body, a cutter rotatably mounted on the cutter journal, a thrust bearing between adjacent surfaces on the journal and cutter, and a retention assembly mounted on one of said journal and cutter and having a first contact face opposed to a second contact face on the other of said journal and cutter, whereby relative axial displacement between each cutter and journal is limited in one direction by said thrust bearing and in the opposite direction by contact between said first and second contact faces, the axial distance between said first and second contact faces of each cutter assembly, when said thrust bearing is fully engaged, being accurately determined by providing on at least one of the journal and cutter a spacer located to adjust the axial distance between the first and second contact faces to be in the range of about 0.002 to 0.010 inches, thereby limiting the maximum permitted axial displacement between the cutter and journal.

23. A drill bit according to claim 22 wherein the spacer is located between the retention assembly and the component on which the retention assembly is mounted so as to adjust the position of the first contact face.

24. A drill bit according to claim 22, wherein the spacer is mounted so as itself to provide the first or second contact face in a position determined by the axial dimension of the spacer.

25. A drill bit according to claim 22, wherein the axial distance between said first and second contact faces, and hence the maximum permitted axial displacement between the cutter and journal, is in the range of about 0.003 inches to 0.006 inches.

26. A rolling cutter drill bit comprising a bit body, a plurality of cutter assemblies each comprising a cutter journal on the bit body, a cutter rotatably mounted on the cutter journal, a thrust bearing between adjacent surfaces on the journal and cutter, and a retention assembly mounted on one of said journal and cutter and having a first contact face opposed to a second contact face on the other of said journal and cutter, whereby relative axial displacement between each cutter and journal is limited in one direction by said thrust bearing and in the opposite direction by contact between said first and second contact faces, the thrust bearing including a thrust washer which is mounted between opposed surfaces on the cutter and journal respectively, and the axial distance between said first and second contact faces of each cutter assembly, when said thrust bearing is fully engaged, being accurately determined by selection of the thickness of the thrust washer to adjust the axial distance between the first and second contact faces to be in the range of about 0.002 to 0.010 inches, thereby limiting the maximum permitted axial displacement between the cutter and journal.

* * * * *